US008833458B2

(12) United States Patent
Malek

(10) Patent No.: US 8,833,458 B2
(45) Date of Patent: Sep. 16, 2014

(54) FACILITY FOR USING FLUID IN A STRETCH OF WATER, AND ASSOCIATED ASSEMBLY METHOD

(75) Inventor: Sami Malek, Versailles (FR)

(73) Assignee: Technip France (FR)

( * ) Notice: Subject to any disclaimer, the term of this patent is extended or adjusted under 35 U.S.C. 154(b) by 438 days.

(21) Appl. No.: 13/128,048

(22) PCT Filed: Nov. 9, 2009

(86) PCT No.: PCT/FR2009/052147

§ 371 (c)(1),
(2), (4) Date: May 6, 2011

(87) PCT Pub. No.: WO2010/052438

PCT Pub. Date: May 14, 2010

(65) Prior Publication Data

US 2011/0220000 A1 Sep. 15, 2011

(30) Foreign Application Priority Data

Nov. 10, 2008 (FR) ..... 08 57627

(51) Int. Cl.
*E21B 7/12* (2006.01)
*E21B 17/01* (2006.01)
*B63B 35/44* (2006.01)

(52) U.S. Cl.
CPC ..... *E21B 17/01* (2013.01); *B63B 2035/442* (2013.01); *B63B 35/4406* (2013.01)
USPC ..... 166/338; 166/341; 166/350; 166/352

(58) Field of Classification Search
USPC ..... 166/338–341, 350–352, 367; 114/264, 114/266; 405/224
See application file for complete search history.

(56) References Cited

U.S. PATENT DOCUMENTS 3,572,041 A * 3/1971 Graaf ..... 405/205
4,042,990 A 8/1977 Donaldson, Jr.

(Continued)

FOREIGN PATENT DOCUMENTS

EP 0202029 A1 11/1986
WO WO 2005/009834 A2 2/2005
WO WO 2006/042178 A1 4/2006

OTHER PUBLICATIONS

International Search Report dated Apr. 7, 2010, issued in corresponding international application No. PCT/FR2009/052147.

*Primary Examiner* — Matthew Buck
*Assistant Examiner* — Aaron Lembo
(74) *Attorney, Agent, or Firm* — Ostrolenk Faber LLP

(57) ABSTRACT

The present disclosure relates to an installation (10) that includes a floating top structure (20) and a fully submerged bottom structure (22). The top structure is mobile between a production position and an evacuation position. The installation (10) retains the top structure (20) in its production position which includes at least one rigid rod (90) carried by the top structure (20), at least one rod abutment (92) carried by the rigid rod (90) in the vicinity of its lower end and at least one complementary abutment (94) secured to a base (60) of the bottom structure (22). Each rod abutment (92) and each complementary abutment (94) are mobile in rotation relative to one another between an engaged configuration in which urging of the rigid rod (90) towards its top position (20) retains the top structure in its production position, and a disengaged configuration releasing the top structure (20) from the bottom structure (22).

16 Claims, 8 Drawing Sheets

(56) References Cited

U.S. PATENT DOCUMENTS

| | | | | | |
|---|---|---|---|---|---|
| 4,234,047 | A * | 11/1980 | Mott | 175/5 |
| 4,279,544 | A * | 7/1981 | Brun et al. | 405/202 |
| 4,606,673 | A * | 8/1986 | Daniell | 405/210 |
| 4,626,137 | A * | 12/1986 | Willemsz | 405/224 |
| 4,702,321 | A * | 10/1987 | Horton | 166/350 |
| 4,913,238 | A | 4/1990 | Danazcko et al. | |
| 4,943,188 | A * | 7/1990 | Peppel | 405/223.1 |
| 5,722,797 | A * | 3/1998 | Horton, III | 405/224 |
| 5,941,746 | A * | 8/1999 | Isnard et al. | 441/4 |
| 6,113,314 | A * | 9/2000 | Campbell | 405/224 |
| 6,196,768 | B1 * | 3/2001 | Allen et al. | 405/224 |
| 6,206,614 | B1 * | 3/2001 | Blevins et al. | 405/224 |
| 6,227,137 | B1 * | 5/2001 | Allen et al. | 114/264 |
| 6,309,141 | B1 * | 10/2001 | Cox et al. | 405/224 |
| 6,336,421 | B1 * | 1/2002 | Fitzgerald et al. | 114/264 |
| 6,371,697 | B2 * | 4/2002 | Huang et al. | 405/224.2 |
| 6,431,107 | B1 * | 8/2002 | Byle | 114/264 |
| 6,666,624 | B2 * | 12/2003 | Wetch | 405/205 |
| 6,869,251 | B2 * | 3/2005 | Zou et al. | 405/205 |
| 7,008,141 | B2 * | 3/2006 | Fitzgerald et al. | 405/224.2 |
| 7,197,999 | B2 | 4/2007 | Murray | |
| 7,537,416 | B2 * | 5/2009 | Wetch | 405/224.2 |
| 7,669,660 | B1 * | 3/2010 | Murray et al. | 166/345 |
| 7,845,998 | B2 * | 12/2010 | Ramachandran et al. | 441/3 |
| 8,047,151 | B2 * | 11/2011 | Foo et al. | 114/230.2 |
| 2001/0013414 | A1 * | 8/2001 | Fitzgerald et al. | 166/366 |
| 2008/0014024 | A1 * | 1/2008 | Lokken et al. | 405/195.1 |
| 2008/0029013 | A1 | 2/2008 | Finn et al. | |

* cited by examiner

FACILITY FOR USING FLUID IN A STRETCH OF WATER, AND ASSOCIATED ASSEMBLY METHOD

CROSS REFERENCE TO RELATED APPLICATIONS

The present application is a 35 U.S.C. §371 National Phase conversion of PCT/FR2009/052147, filed Nov. 9, 2009, which claims benefit of French Application No. 0857627, filed Nov. 10, 2008, the disclosure of which is incorporated herein by reference. The PCT International Application was published in the French language.

BACKGROUND OF THE INVENTION

The present invention relates to an installation for fluid production in a stretch of water, of the type comprising:

- a top floating structure extending partly above the surface of the stretch of water;
- a bottom structure fully submerged under the surface of the stretch of water, the bottom structure comprising a base positioned distant from the bed of the stretch of water, and means for anchoring the base onto the bed of the stretch of water;
- at least one fluid conveying riser intended to connect a bed assembly positioned on the bed of the stretch of water to a surface assembly positioned on the top structure;

the top structure being mobile between a production position mounted on the bottom structure, and an evacuation position placed away from the bottom structure, the installation comprising means for retaining the top structure in its production position.

Said installation is intended in particular for the conveying of hydrocarbons, recovered from the bed of a stretch of water, up to the surface through the stretch of water.

This type of installation generally comprises a floating structure, such as a platform arranged partly above the surface of the stretch of water, and a lower keel buoy anchored to the bed of the stretch of water. The top floating structure is reversibly fixed to the buoy.

The installation further comprises a plurality of flexible risers which connect a production assembly positioned on the bed of the stretch of water to an upper surface of the floating structure, via the buoy and the platform.

Said installation is intended for the production of hydrocarbon deposits for example, located in the bed of a stretch of water such as a lake, the sea or an ocean, under conditions in which the halting of production and rapidly performed safeguarding procedure of the production installation may be necessary.

Such conditions are encountered in particular in regions in which the stretch of water is temporarily or permanently covered with a layer of ice, as in polar regions.

In these regions, the layer of ice present on the surface of the stretch of water is relatively mobile. It may therefore partly damage the floating structure when it is anchored to the bed of the stretch of water.

Rapid safeguarding of the production installation may also be necessary when the atmospheric conditions on the surface of the stretch of water require fast evacuation of the platform.

This may be the case in particular in regions in which storms, even cyclones, are a possible occurrence.

To proceed with emergency disconnection, the flexible risers are first disconnected from the top floating structure.

Next, the means retaining the top floating structure on the bottom structure are released and the floating structure is convoyed from its production position towards an evacuation position in safer waters.

One example of an installation comprising a detachable floating structure is described in U.S. Pat. No. 7,197,999 to the Applicant. This installation is a platform of floating cylinder type known as a <<SPAR>> platform.

Said installation comprises a bottom structure having flexible securing cables secured onto the top structure, which can be swiftly and easily detached to allow evacuation of the top structure.

However, the subsequent re-connecting of the bottom structure to the top structure requires the re-connection of each cable onto the top structure, which can be tedious.

SUMMARY OF THE INVENTION

It is therefore one objective of the invention to obtain a fluid production installation for which safety procedure can be very swiftly carried out by disconnecting a floating top structure from a bottom structure submerged under the stretch of water, it being possible to place the installation back into production simply and within the shortest time possible.

For this purpose, the subject of the invention is an installation of the afore-mentioned type, characterized in that the retaining means comprise:

- at least one rigid rod carried by the top structure, the rigid rod extending between an upper end located above the surface of the stretch of water and a lower end, the rigid rod being mounted mobile in translation relative to the top structure between a bottom position in which the lower end projects outwardly towards the base and a top position retracted towards the top structure;
- at least one rod abutment, carried by the rigid rod in the vicinity of the lower end;
- at least one complementary abutment secured to the base, the or each rod abutment and the or each complementary abutment being mobile in rotation relative to one another between an engaged configuration in which urging of the rigid rod towards its upper position holds the top structure in its production position on the bottom structure, and a disengaged position releasing the top structure from the bottom structure.

The installation of the invention may comprise one or more of the following characteristics taken alone or in any technically possible combination:

- the or each rod abutment projects radially outwards relative to a peripheral surface of the rigid rod delimiting at least one axial insertion passage for the or for each complementary abutment, the or each complementary abutment delimiting at least one complementary axial passage for the or for each rod abutment during axial movement of the rigid rod between its top position and its bottom position;
- the or each rod abutment is located on an outer peripheral surface of the rigid rod and projects radially away from the rod axis, the base delimiting a passage for inserting the lower end of the rigid rod, the or each complementary abutment projecting radially into the insertion passage towards the rod axis when the rigid rod is inserted in the insertion passageway;
- the retaining means comprise a mechanism for driving the rigid rod in translation between its top position and its bottom position, the mechanism for driving in translation being carried by the top structure above the surface of the stretch of water;

the or each complementary abutment is mounted fixedly in rotation around a rod axis relative to the base, the rigid rod being mounted mobile in rotation around the rod axis to cause the or each rod abutment to change from its engaged configuration to its disengaged configuration when the rigid rod takes up its bottom position, the retaining means comprising a mechanism for driving the rigid rod in rotation around the rod axis, the mechanism for driving in rotation being carried by the top structure and being arranged above the surface of the stretch of water;

the mechanism for driving the rigid rod in translation is carried by the mechanism for driving the rigid rod in rotation, and can be moved in rotation around the rod axis jointly with the rigid rod when the or each of rod abutment moves between its engaged configuration and its disengaged configuration;

the base is held away from the bed of the stretch of water by its own buoyancy, the anchoring means comprising at least one flexible line connecting the base to the bed of the stretch of water;

the top structure has a height, taken along the rod axis, that is greater than at least twice the maximum transverse dimension of the top structure, taken perpendicular to the rod axis;

the top structure delimits a passage for inserting the retaining rod, the upper insertion passage having at least one inner cross-sectional part complementary with the outer cross-section of the rigid rod, positioned under the surface of the stretch of water;

the conveying riser has at least one upper part flexible over its entire length, mobile between a lower disengaged configuration of the top structure retained by the bottom structure, and an upper connection configuration onto the top structure, in which its upper part is connected to the top structure;

A further subject of the invention is a fluid production method in a stretch of water using an installation such as defined above, characterized in that it comprises the following steps:

placing the top structure of the installation facing the bottom structure;

moving the retaining rod from its top position to its bottom position so that it engages in the bottom structure;

rotating the or each rod abutment relative to the or each complementary abutment to move the or each rod abutment to its engaged configuration with a complementary abutment;

applying an urging force to the retaining rod towards its top position, to apply the top structure against the bottom structure;

engaging the fluid conveying riser through the top structure, and connecting the upper end of the fluid conveying riser to the top structure.

The method of the invention may comprise an emergency disconnecting step comprising:

disconnecting the fluid conveying riser and moving it away from the top structure, rotating the or each rod abutment relative to the or each complementary abutment between the engaged configuration and the disengaged configuration, and moving the retaining rod from its bottom position to its top position, moving the top structure away from the bottom structure towards its evacuation position.

BRIEF DESCRIPTION OF THE DRAWINGS

The invention will be better understood on reading the following description given solely by way of example and with reference to the appended drawings, in which.

DESCRIPTION OF PREFERRED EMBODIMENTS

Figure 1:
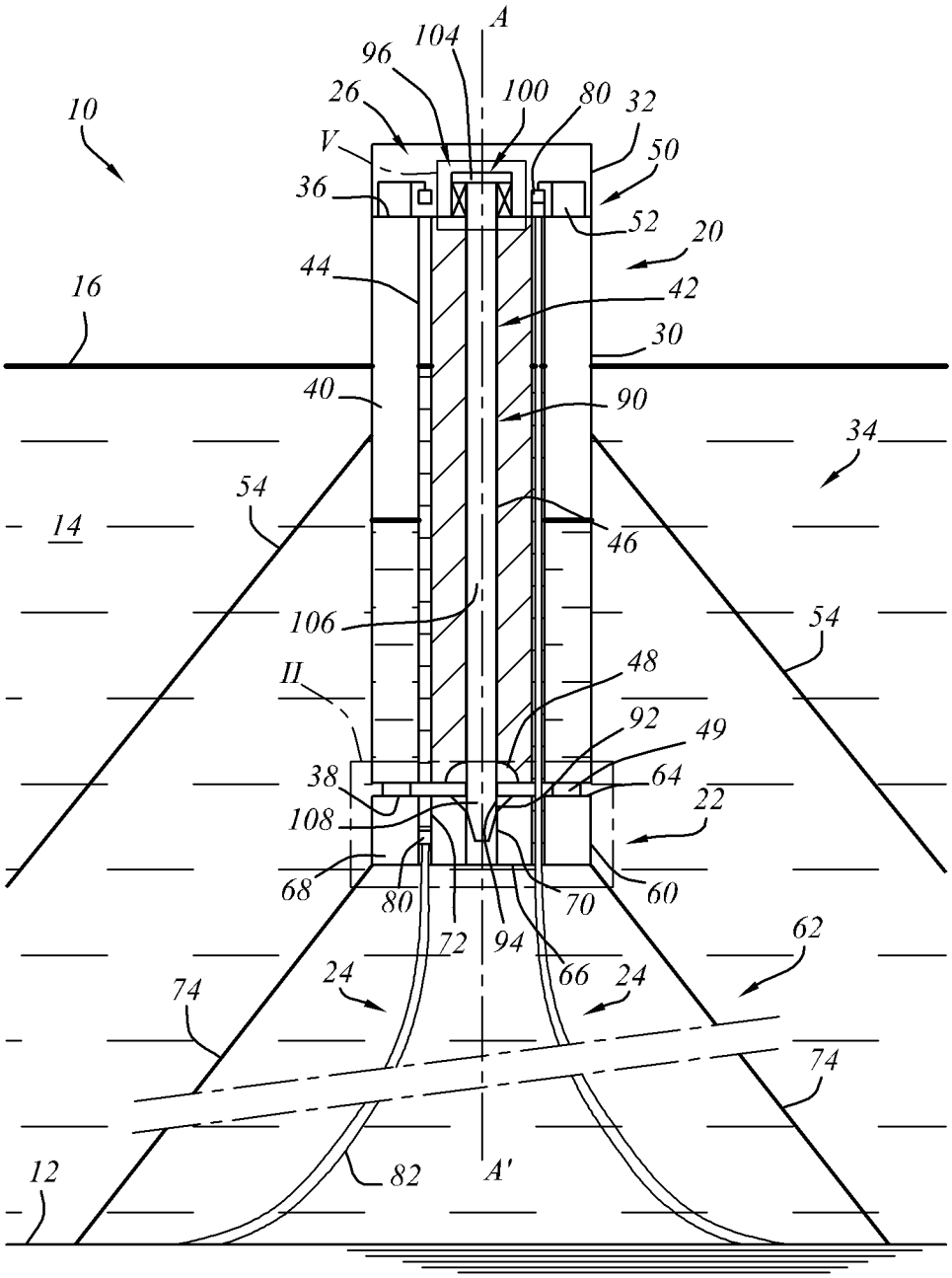
FIG. 1 is a schematic, partial cross-sectional view along a median vertical plane of a first fluid production installation according to the invention, wherein the top floating structure is attached to the bottom structure.

In the remainder hereof, the terms <<upstream>> and <<downstream>> are to be construed in relation to the normal direction of circulation of a fluid in a riser.

A first fluid production installation 10 according to the invention is illustrated FIGS. 1 to 6.

This installation 10 is intended to convey a fluid, recovered in the bed 12 of a stretch of water 14, from a fluid-producing bed assembly (not illustrated) up to the surface 16 of the stretch of water 14.

The fluid may, for example, consist of liquid hydrocarbons and/or gases collected in wells arranged on the bed 12.

The stretch 14 may be a lake, sea or ocean for example. It lies on the bed 12 and has a depth, taken between the surface 16 and the bed 12 opposite the installation 10, of more than 300 m and may range between 300 m and 3000 m for example.

Figure 7:
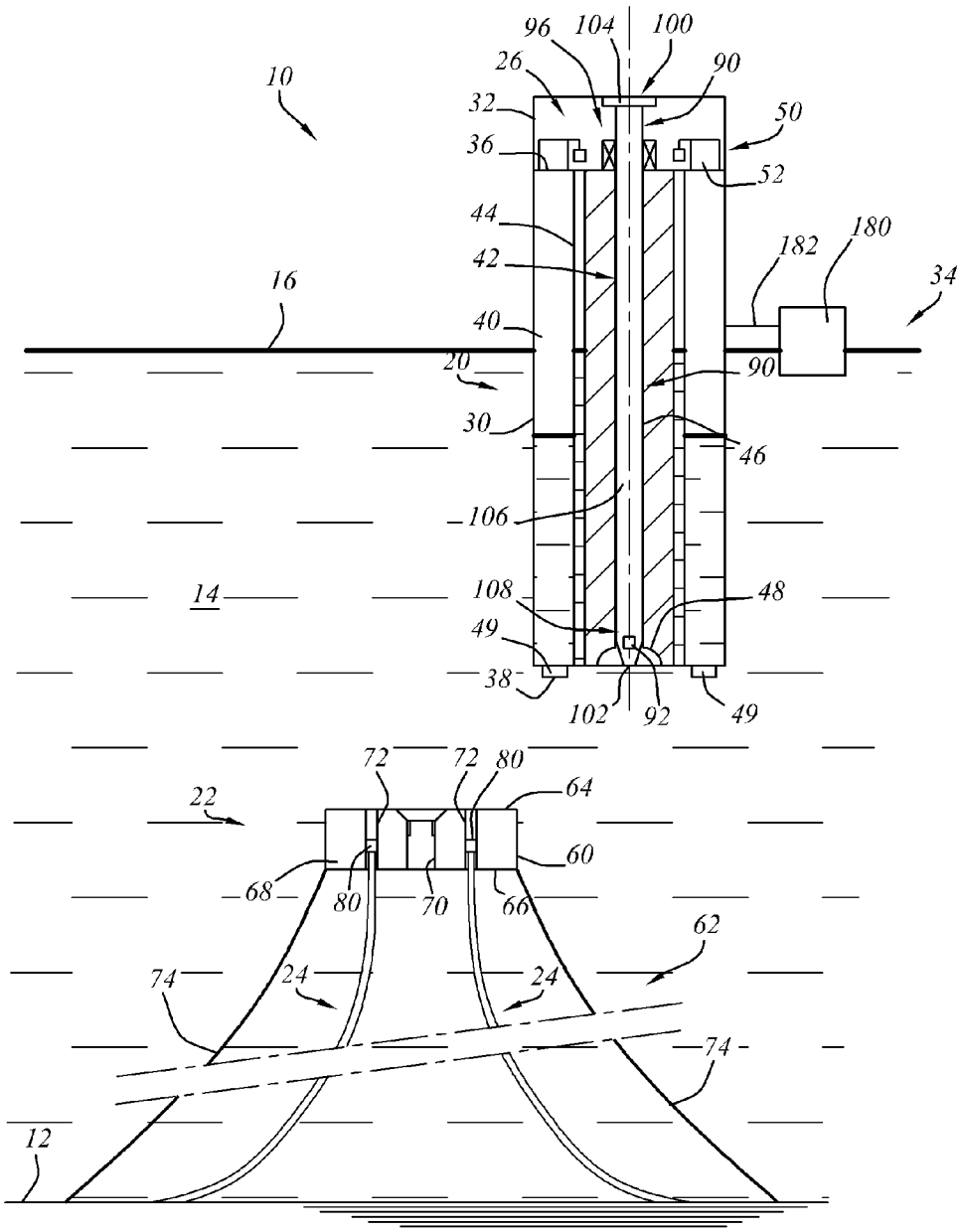
FIG. 7 is a similar view to FIG. 1, the top structure being disconnected from the bottom structure.

The installation 10 comprises a top floating structure 20, a submerged bottom structure 22, the top structure 20 being mobile relative to the submerged structure 22 between a production position illustrated FIG. 1 and an evacuation position illustrated FIG. 7.

The installation 10 further comprises at least one flexible riser 24 for conveying fluid, intended to extend between the bed assembly on the bed 12 of the stretch of water and a surface assembly, through the bottom structure 22 and the top structure 20.

The installation 10 further comprises means 26 for retaining the top structure 20 in its production position on the bottom structure 22, these means 26 being reversibly releasable.

In the example shown in FIG. 1, the top structure 20 and the bottom structure 22 form two parts of a floating platform of <<riser type>> partly submerged in the stretch of water 14, commonly known under its acronym: <<SPAR>>.

Therefore said installation 10 has a vertically elongate top structure 20 having a height taken along a vertical axis A-A', that is greater than the maximum transverse dimension of the structure 20, taken perpendicular to the axis A-A'. Advantageously, the height of the structure 22 is greater than at least twice the maximum transverse dimension of the top structure 20.

With reference to FIG. 1, the top structure 20 comprises a hull 30 partly submerged in the stretch of water, a surface assembly 32 carried by the hull above the surface 16 of the stretch of water, and upper releasable means 34 for anchoring the hull 30 to the bed 12 of the stretch of water 14.

In this example, the hull 30 is of substantially cylindrical elongate shape 30 of vertical axis A-A', whose cross section is substantially constant.

In one variant (not illustrated), the hull 30 has an intermediate narrowing of smaller diameter than the mean diameter of the hull 30, located at the surface 16 of the stretch of water 14.

The hull 30 extends between an upper 36 located above the surface 16 of the stretch of water and a lower surface 38 located beneath the surface 16 of the stretch of water, facing the bottom structure 22 in the production position.

The height of the hull 30, taken between the upper surface 36 and the lower surface 38, is greater than 100 m and for example ranges from 100 m to 250 m.

The hull 30, on its lower surface 38, also has skids 49 to be applied to the bottom structure 22 intended to come into contact with the bottom structure 22.

The hull 30 defines a plurality of upper buoyancy tanks 40 able to be selectively filled with liquid or gas to modify the overall buoyancy of the top structure 20, and areas for storing fluid recovered from the bed 12.

The top structure 20 therefore comprises means (not illustrated) for selectively inserting gas or liquid into each tank 40 to modify the content thereof.

The hull 30 also innerly delimits at least one upper axial passage 42 for inserting retaining means 26, and at least one upper axial passage 44 for circulation of the or of each flexible riser 24 separate from the axial passageway 42.

The axial insertion passageway 42 opens upwardly into the surface 36 and downwardly into the lower surface 38. It has an upper part 46 of substantially constant section and a lower part 48 flaring downwardly opposite the bottom structure 22.

In the example illustrated FIG. 1, the axial passage 42 for inserting the retaining means 26 extends substantially towards the centre of the structure 22, along axis A-A'.

Each axial circulation passage 44 opens upwardly into the upper surface 36 and downwardly into the lower surface 38.

The surface assembly 32 is arranged above the upper surface 36 and above the surface 16 of the stretch of water. It comprises a connection station 50 for the or for each flexible riser 24.

The station 50 comprises at least one manifold 52 associated with each conveying riser 24, and handling means (not illustrated) able to guide the conveying riser 24 through an axial passageway 44 as far as the manifold 52.

The upper anchoring means 34 comprise flexible anchor lines 54 reversibly deployable from the hull 30 to be attached to the bed 12 of the stretch of water 14.

The anchor lines 54 are tensioned between a point secured to the hull 30 and a point fixed in the bed 12 of the stretch of water 14.

The bottom structure 22 is fully submerged in the stretch of water 14. It comprises a base 60 floating in the stretch of water 14 distant from the bed 12, and lower anchoring means 62 anchoring the base 60 to the bed 12 of the stretch of water.

The base 60 is also of cylindrical shape of vertical axis A-A'. Its cross-section is substantially identical to the mean cross-section of the hull 30.

The base 60 has a maximum horizontal section greater than the maximum horizontal section of the lower anchoring means 62.

The base 60 extends between a substantially horizontal bearing upper surface 64 of the top structure 20 and a lower surface 66 positioned distant from the bed 12 of the stretch of water.

The height of the base 60, taken between the surfaces 64, 66, is smaller than at least twice the height of the hull 30, taken between the surfaces 36, 38. It is also smaller than the maximum cross span of the base 60.

The base 60 comprises at least one lower buoyancy tank 68 intended to be filled at least partly with gas.

It delimits at least one lower passage 70 for inserting securing means 26 and, for each upper circulation passage 44, at least one lower circulation and retaining passage 72 for a flexible riser 24.

The tanks 68 are filled at least partly with gas to ensure the buoyancy of the base 60. Therefore, the base 60 is held away from the bed of the stretch of water 12 under the effect of its own buoyancy in the stretch of water 14 when it is disconnected from the top structure 20.

The distance which separates the lower surface 66 from the bed 12 is greater than 50 m for example. Also, the distance which separates the surface 16 of the stretch of water 12 from the upper surface 64 is greater than 100 m.

The lower insertion passage 70 opens upwardly into the upper surface 64 opposite the lower part 48 of the upper axial insertion passage 42 when the top structure 20 is placed in its production position in contact with the bottom structure 22.

The upper part of the lower passage 70 flares out upwardly.

Similarly, each lower passage 72 for the circulation of a fluid conveying riser 24 opens upwardly into the upper surface 64, and opens downwardly.

The anchoring means 62 comprise a plurality of anchor lines 74 fixed at a first point on the base 60 and fixed at a second point in the bed 12 of the stretch of water. The anchor lines 74 oppose the upward displacement force of the base 60 due to its buoyancy, to immobilize the base 60 vertically.

The lines 74 also hold the base 60 in a substantially constant horizontal position relative to the bed 12 of the stretch of water.

As seen in the foregoing, the top structure 20 can be moved relative to the bottom structure 22 between a production position, in which its lower surface 38 is applied against the upper surface 64 of the bottom structure 22, and an evacuation position in which the upper surface 64 and the lower surface 38 are drawn away from each other being horizontally offset.

Figure 2:
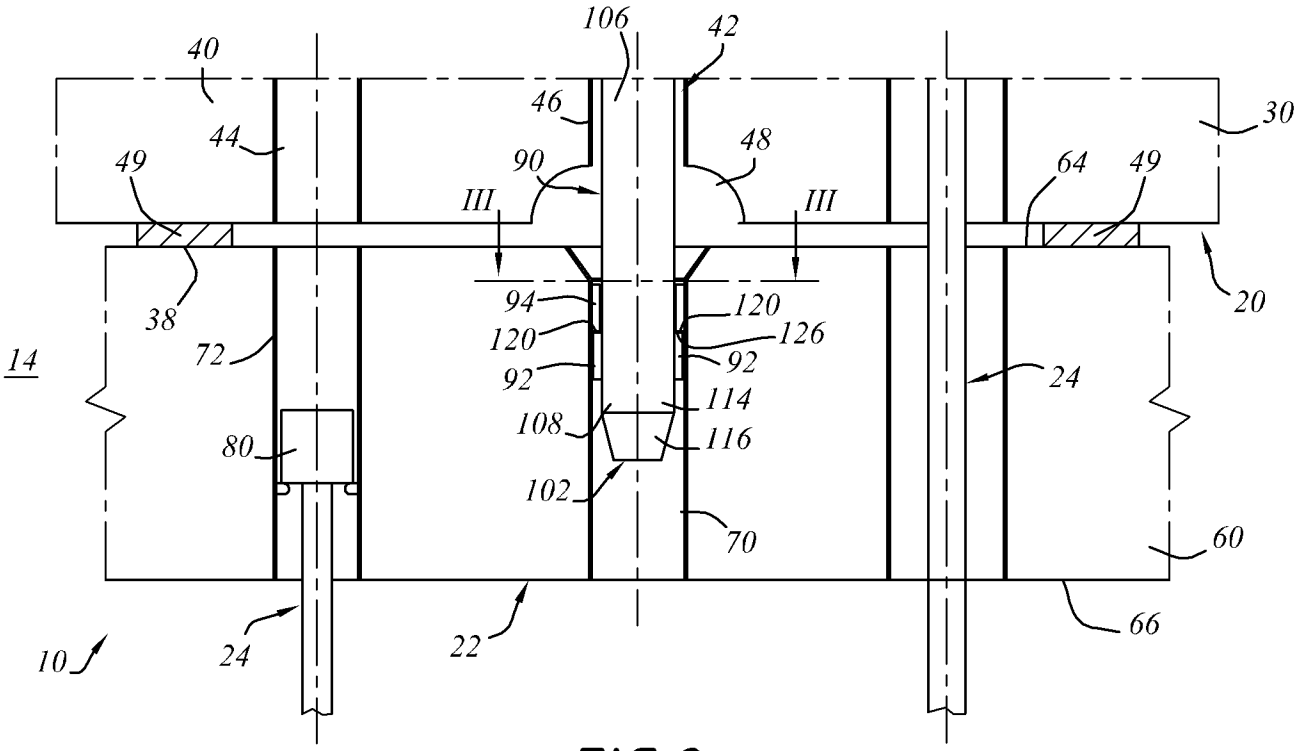
FIG. 2 is a view of a detail labelled II in FIG. 1.

In the production position which can be seen FIGS. 1 and 2, the skids 49 present on the lower surface 38 are applied to the upper surface 34 of the bottom structure 22 and are held in this position by the retaining means 26. In this position, the upper axial passage 42 opens opposite the lower axial passage 70, and each axial passage 44 opens opposite a lower axial passage 72.

In the evacuation position, which can be seen FIG. 7, the top structure 20 has been displaced horizontally relative to the bottom structure 22.

The space located above the upper surface 64 in the stretch of water 14 is cleared, as is the space located in the stretch of water 14 below the lower surface 38.

Each fluid conveying riser 24 extends between a lower end connected to the bed assembly (not illustrated) and an upper end 80 intended to be connected onto a manifold 52 of the loading station 50. It innerly delimits a continuous passageway 82 for fluid circulation.

Each flexible riser 24 is mobile between a lower rest configuration illustrated on the left in FIG. 1, and an upper fluid conveying configuration illustrated on the right in FIG. 1.

In the rest configuration, the upper end 80 of the riser 24 is retained in a lower axial passage 72 of the lower structure 22, and the riser 24 is disengaged from the top structure 20. It assumes a catenary or wave shape.

In the upper configuration for fluid transportation, the conveying riser 24 has been lifted up through a lower circulation passage 72 and through an upper circulation passage 44 as far as the manifold 50 on the surface assembly 32, to which the end 80 is connected.

According to the invention, the retaining means 26 comprise a rigid retaining rod 90 extending through the top structure 20, rod abutments 92 carried by the rigid rod 90 and complementary abutments 94 intended to engage the rod abutments 92, the complementary abutments being carried by the lower structure 22.

The retaining means 26 also comprise means 96 for moving the rigid rod 90 in translation along the vertical rod axis A-A' and in rotation around the vertical axis A-A', these displacing means 96 being carried by the top structure 22 above the surface 16 of the stretch of water 14.

The rigid rod 90 extends between an upper end 100 intended to project above the upper surface 36 of the hull 30, and a lower end 102 intended to be engaged in the bottom structure 22.

The rigid rod 90, from bottom to top between its upper end 100 and its lower end 102, comprises a hollow collar 104 linking with the displacing means 96 (as seen FIG. 5), a rigid tube 106 successively extending through the displacing means 96, the upper axial insertion passage 42 as far as the lower surface 38. The rod 90 further comprises a connecting head 108 on the bottom structure 22 which projects from the lower surface 38 and which carries the rod abutments 92.

Figure 5:
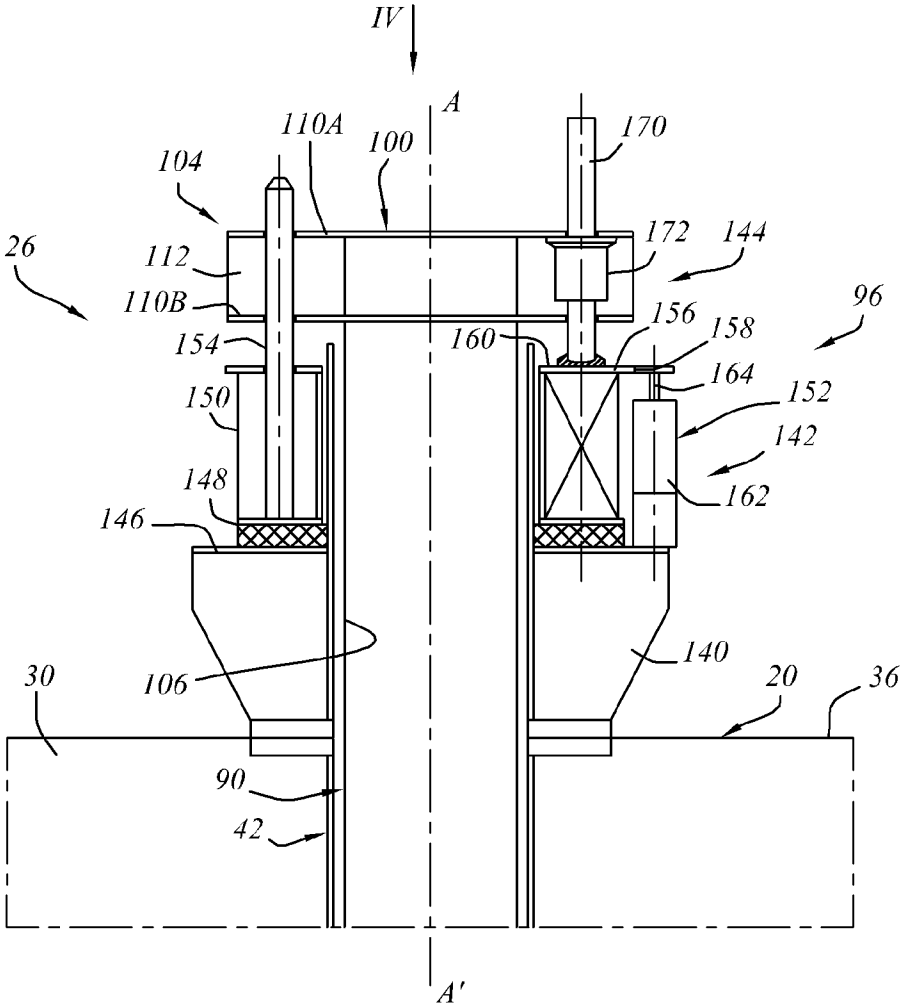
FIG. 5 is a view of a detail labelled V in FIG. 1 illustrating the means for driving a retaining rod of the installation shown FIG. 1 in translation and in rotation.

With reference to FIG. 5, the collar 104 is formed of two horizontal parallel discs 110A, 110B delimiting an annular cavity 112 between them.

The discs 110A, 110B are secured to the tube 106 and can be jointly moved in rotation with the tube 106.

The tube 106 is hollow in the example illustrated in the Figures. Its length is greater than the length of the hull 30, taken between the upper surface 36 and the lower surface 38.

The tube 106 is rigid, so that it has a minimum radius of curvature greater than at least 50% of the height of the hull 30. It has an outer cross section conjugate with the inner axial circulation passage 42 at least in a submerged part of the top structure 20, along the upper part 46.

The connecting head 108 has a substantially cylindrical outer peripheral surface 114 for attachment of the abutments 92 and a lower surface 116 converging downwards.

The outer peripheral surface 114 has an outer diameter substantially equal to the inner diameter of the passage 70, less twice the thickness of a rod abutment 92.

Figure 4:
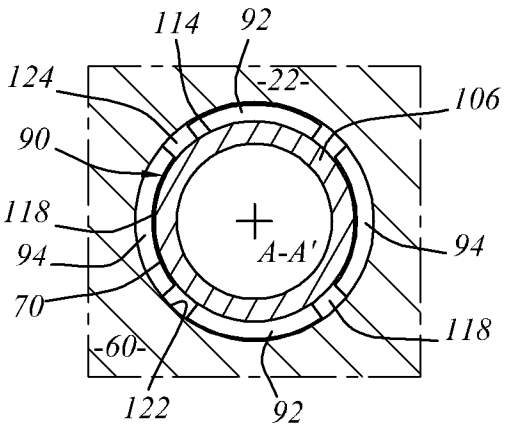
FIG. 4 is a similar view to FIG. 3, when disengaging the rod abutments from the complementary abutments of the installation shown FIG. 2.

As illustrated FIG. 4, the rod abutments 92 project radially from the outer peripheral surface 114 away from the axis A-A'.

The rod abutments 92 have an outer cross section substantially conjugate with the inner cross section of the lower insertion passage 70.

Each rod abutment 92 extends at an angle around the axis A-A', within an angle sector of less than 180°. The rod abutments 92 are spaced angularly and delimit axial passages 118 between them, for insertion of the complementary abutments 94, opening upwardly and downwardly In the example illustrated FIG. 4, the abutments 92 total 2 in number. In addition, each rod abutment 92 extends within an angular sector of less than 70° around the axis A-A'. There is therefore an angular interstice of about 20° between each rod abutment 92 and each complementary abutment 94 when the rigid rod 90 is lowered along axis A-A' through the lower passage 70.

Each rod abutment 92 has an upper bearing surface 120 on a complementary abutment 94. This bearing surface 120 is substantially horizontal.

Each rod abutment 92 is secured to the outer peripheral surface 114 so that it can be displaced together with the rigid rod 90 in translation along the axis A-A' and in rotation around the axis A-A'.

The complementary abutments 94 project from the base 60 into the lower passage 70 towards the axis A-A'. Their thickness is substantially equal to the distance separating the inner surface 122 delimiting passageway 70 and the peripheral surface 114, when the head 108 is inserted in the passage 70. They are secured onto the surface 122.

Therefore, when the rigid rod 90 is rotated relative to the bottom structure 22, the complementary abutments 94 remain fixed relative to the rod abutments 92.

Each complementary abutment 94 extends within an angle sector of less than 70° located around the axis A-A'.

The abutments 94 therefore delimit between them complementary axial passages 124, for insertion of the rod abutments 92, which open upwardly and downwardly.

Each complementary abutment 94 also delimits a substantially planar lower surface 126 intended to cooperate with the upper surface 120 of a corresponding rod abutment 92.

Therefore, when the rod abutments 92 have been inserted through the complementary insertion passages 124 and lie vertically below the complementary abutments 94, the rod abutments 92 are mobile in rotation relative to the complementary abutments 94 between an engaged position retaining the top structure 20 in position against the bottom structure 22, and a disengaged configuration releasing the top structure 20 from the bottom structure 22.

Figure 3:
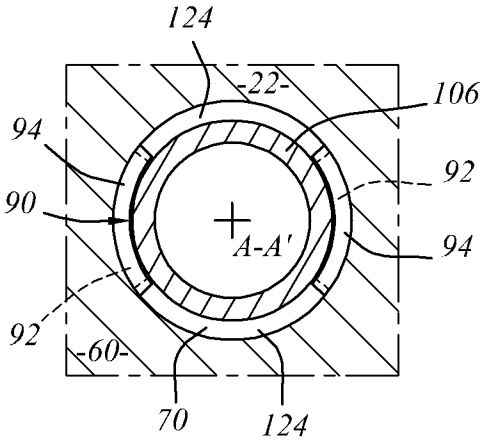
FIG. 3 is a cross-sectional view along the transverse plane III in FIG. 2.

In the engaged retained position configuration illustrated FIG. 3, the rod abutments 92 are located underneath the complementary abutments 94 facing them at an angle relative to the axis A-A'.

The upper surfaces 120 of the abutments 92 are in contact with the lower surfaces 126 of the complementary abutments 94, so that upward traction on the rigid rod 90 allows the transmission of an upward directed force between the rigid rod 90 and the bottom structure 22, to apply this bottom structure 22 against the top structure 20.

In the disengaged configuration, the rod abutments 92 are offset at an angle from the complementary abutments 94 and are placed facing a complementary axial passage 124. In this configuration, the upper surfaces 120 are located at an angle away from the lower surfaces 126.

Upward traction of the rigid rod 90 in this configuration allows the rod 90 to be moved freely relative to the bottom structure 22, without exerting any substantial upward-directed substantial force on the bottom structure 22 which would hold the bottom structure 22 against the top structure 20.

As illustrated FIG. 5, the displacing means 96 comprise an annular support 140, a mechanism 142 for driving the rigid rod 90 in rotation about the axis A-A', and a mechanism 144 for driving the rigid rod 90 in translation along the axis A-A'.

In this example, the translational driving mechanism 144 is carried by the rotational driving mechanism 142 so that it can be moved in rotation jointly with the rod 90.

The support 140 is arranged bearing upon the upper surface 36 around the upper opening of the axial insertion passage 42.

The support 140 has a substantially planar, upper annular surface 146 on which an annular anti-friction pad 148 is arranged.

The annular pad 148 is formed of a material having a low coefficient of friction e.g. Teflon.

The mechanism 142 for driving in rotation comprises a rotating annular ring 150 and a device 152 for driving the rotating ring 150 in rotation.

The mechanism 142 also comprises a plurality of vertical rods 154 for driving the collar 104 in rotation, which project from the rotating ring 150.

The rotating ring 150 comprises a cogged upper disc 156 which has outer peripheral cogging 158 projecting radially away from the axis A-A' around the axis A-A'.

The upper disc 156 also has an upper horizontal bearing surface 160 for the translational driving mechanism 144.

The ring 150 is arranged bearing upon the anti-friction pad 148 so that it rotates by sliding on the pads 148 around the axis A-A'.

The device 142 for driving in rotation comprises a hydraulic motor 162 and a vertical drive sprocket 164 for the rotating ring 150. The sprocket 164 is driven in rotation by the motor 162.

The rotating sprocket 164 is peripherally meshed on the cogging 158. Actuation of the hydraulic motor 162 allows the sprocket 164 to be driven in rotation around an axis parallel to axis A-A' and, via meshing, the annular ring 150 around the axis A-A'.

Figure 6:
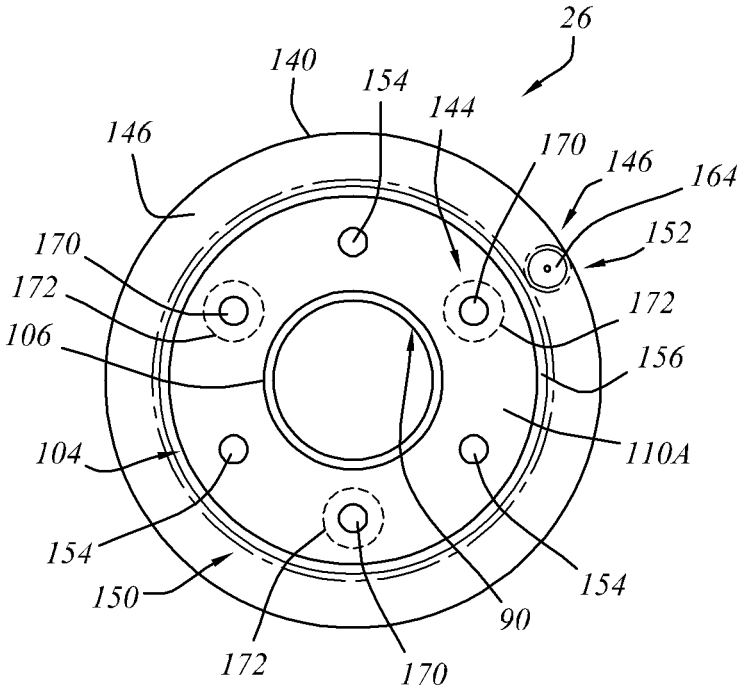
FIG. 6 is an overhead view taken along arrow VI in FIG. 5.

As illustrated FIG. 6, the rods 154 are distributed at an angle around the ring 150. They project upwardly parallel to axis A-A' through the upper surface 160.

Each rod 154 is engaged through complementary openings arranged in the discs 110A, 110B of the collar 104. Therefore, rotation of the ring 150 causes joint rotation of the rods 154, driving of the collar 104 in rotation around the axis A-A' and hence of the rigid rod assembly 90 around the axis A-A'.

The translational driving mechanism 144 comprises a plurality of screw-and-nut assemblies 170, 172 each comprising a fixed screw 170 and a hydraulic nut 172.

In this example, the translational driving mechanism 144 comprises three screw-and-nut assembles 170, 172 distributed at an angle around the axis A-A', as illustrated FIG. 6.

The screw 170 of each assembly 170, 172 is fixed to the upper surface 160 of the disc 158. It extends along a vertical axis parallel to axis A-A' through complementary openings arranged in the upper disc 110A and in the lower disc 110B of the collar 104.

The hydraulic nut 172 is arranged in the cavity 112 between the discs 110A, 110B bearing against the underside of the upper disc 110A.

The nut 172 is screwed onto the screw 170. It is provided with self-contained means for driving it in rotation around the axis of the screw 170. Therefore, the hydraulic nut 172 can be moved by screwing or unscrewing on the screw 170 between a bottom position and a top position.

When the nut 172 is moved upwardly, the nut 172 bears against the underside of the upper disc 110A and pushes the disc 101A, the collar 104, the tube 106 and more generally the entire rigid tube 90 upwardly along the axis A-A'.

On the contrary, when the nut 172 is lowered around the screw 170, the disc 110A, the collar 104 and the tube 106 and more generally the entire rigid rod 90 are lowered in particular under the effect of the weight of the rigid rod 90.

The rigid rod 90 can therefore be moved in translation along the axis A-A' under the effect of the driving mechanism 144 between a top position with disengagement of the structure 22 illustrated FIG. 7, and a bottom position with engagement of the structure 22 as illustrated FIGS. 1 and 2.

In the top position the length of the rigid rod 90 projecting above the upper surface 36 is maximal, and the length of the lower head 108 projecting underneath the lower surface 38 is minimal.

In the bottom position, the length of the rigid rod 90 projecting beyond the upper surface 36 is minimal, and the length of the lower head 108 projecting downwardly away from the surface 38 is maximal.

In addition, in this bottom position, when the lower head 108 and the abutments 92 have been inserted underneath the complementary abutments 94 causing them to move between the complementary abutments 94 in the complementary insertion passages 124, the rigid rod 90 is mobile in rotation around the axis A-A' via the mechanism 142 between the disengaged configuration of the rod abutments 92 and the engaged configuration of the rod abutments 92 described above.

The assembling and functioning of a first installation 10 according to the invention will now be described.

Initially, the bottom structure 22 is lowered into the stretch of water 14 and the base 60 is anchored at a distance from the bed 12 of the stretch of water 14 by means of the lower anchoring means 62. The flexible risers 24 are engaged through the lower circulation passages 72.

In this configuration, the base 60 is held in vertical position via its buoyancy. Its lower surface 66 is positioned away from the stretch of water 14.

Then the top structure 20 is brought opposite the bottom structure 22 leaving it to float on the surface 16 of the stretch of water 14 being partly submerged. During this operation, the upper surface 36 remains above the surface 16 of the stretch of water 14.

Next, the lower surface 38 of the hull 30 is placed vertically opposite and above the upper surface 64 of the base 60. The buoyancy of the top structure 20 is then reduced to cause the lower surface 38 to be gradually lowered into contact with the upper surface 64, via skids 49.

During this movement, the upper circulation passages 46 are placed at an angle and axially opposite the lower circulation passages 72. Similarly the, or each, lower insertion passage is placed opposite the upper insertion passage 42.

The rigid rod 90 then takes up its top position.

The angular position of the rod abutments 92 is then adjusted around the axis A-A' so that these abutments 92 come to lie at an angle opposite the complementary insertion passages 124 located between the complementary abutments 94.

This angular movement is conducted by actuating the hydraulic motor 162, by rotating the drive sprocket 164 and the ring 150 to drive the rods 154 and the collar 104.

The translational driving mechanism 144 is then actuated to lower the rigid rod 90 from its top position to its bottom position.

The hydraulic nut 172 moves down along the screw 170 and, under the effect of its weight, the rigid rod 90 also moves down along the axis A-A' being guided within the axial passage 42.

The lower head 108 then enters the lower insertion passageway 70 and the rod abutments 92 move downwards underneath the complementary abutments 94 passing between the complementary abutments 94 via the complementary passages 124.

During this movement, the complementary abutments 94 pass between the rod abutments 92 inside the insertion passages 118.

When the upper surfaces 120 of the rod abutments 92 lie underneath the lower surfaces 126 of the complementary abutments 94, the downward translation of the rod 90 along axis A-A' is halted.

The rod abutments 92 and the complementary abutments 94 then take up their disengaged configuration described above, as can be seen FIG. 4.

To lock the top structure 20 onto the bottom structure 22, the mechanism 142 for driving the rigid rod 90 in rotation is then actuated as described previously, to cause the rigid rod to pivot at an angle of more than 90° and to cause the rod abutments 92 to change from their disengaged configuration to their engaged configuration, as can be seen in FIG. 3.

During this movement, the upper surfaces 120 of the abutments 92 position themselves at an angle opposite the lower surfaces 126 of the complementary abutments 94.

The rod 90 is then slightly lifted upward by the translational driving mechanism 144. This allows the upper surface 64 of the structure 22 to be firmly applied against the lower surface 38 of the hull 30, and the top structure 20 to be firmly held against the bottom structure 22 by cooperation between the upper surface 120 of each rod abutment 92 and the lower surface 126 of the opposite-facing complementary abutment 96.

The upper anchoring means 34 are then placed in position to immobilize the top structure 20.

The fluid conveying risers 24 are then moved up as far as the top station 50 on the surface through the passages 72 and are connected to a manifold 52.

The fluid collected in the bed assembly is then conveyed through the circulation passage 82 of each conveying riser 24 from the bed assembly to the manifold 52.

In the event of an emergency, the conveying risers 24 are disconnected from the manifolds 52 and are rapidly lowered down to the bottom structure 22 through the upper axial passages 44.

Next, the rigid rod 90 is lowered to clear each upper surface 120 away from each lower surface 126. The rigid rod 90 is then driven in rotation by the rotational driving means 142 to cause the rod abutments 92 to change from their engaged configuration to their disengaged configuration. The translational driving mechanism 144 of the rigid rod 90 is then actuated to lift the rod 90 up to its top position.

The anchor lines 54 of the top structure 20 are then released and the top structure 20 is lifted up away from the bottom structure 22 so that it can rapidly be evacuated towards its evacuation position, for example by a towing vessel 180 linked to the top structure via a line 182.

The retaining means 26 of the installation according to the invention 10 therefore allow the robust, reliable locking of a top structure 20 floating above the surface 16 and partly submerged in the stretch of water 14 onto a bottom structure 22 intended to remain permanently under the surface 16 of the stretch of water 14.

This simple, robust attachment is obtained in particular through the use of a rigid rod 90 passing through the top structure 20.

In addition, the release of the top structure 20 from the bottom structure 22 is facilitated through the presence, on the surface, of a mechanism 142 and a mechanism 144 respectively driving the rigid rod 90 in rotation and in translation, which are therefore not subject to fouling.

The maintenance of said installation is therefore reduced, in particular regarding the retaining means 26 thereof.

As a variant, the translational driving mechanism 144 cannot be moved in rotation around the axis A-A'.

In another variant, the translational driving mechanism 144 comprises a screw 170 mobile in rotation around an axis A-A' relative to the collar 104 and a nut 172 rotationally fixed relative to this collar 104.

As a variant, at least one centring disc (not illustrated) limiting buckling of the rigid rod 90 when it is lowered from its top position to its bottom position is arranged in the upper axial passageway 42.

Figure 8:
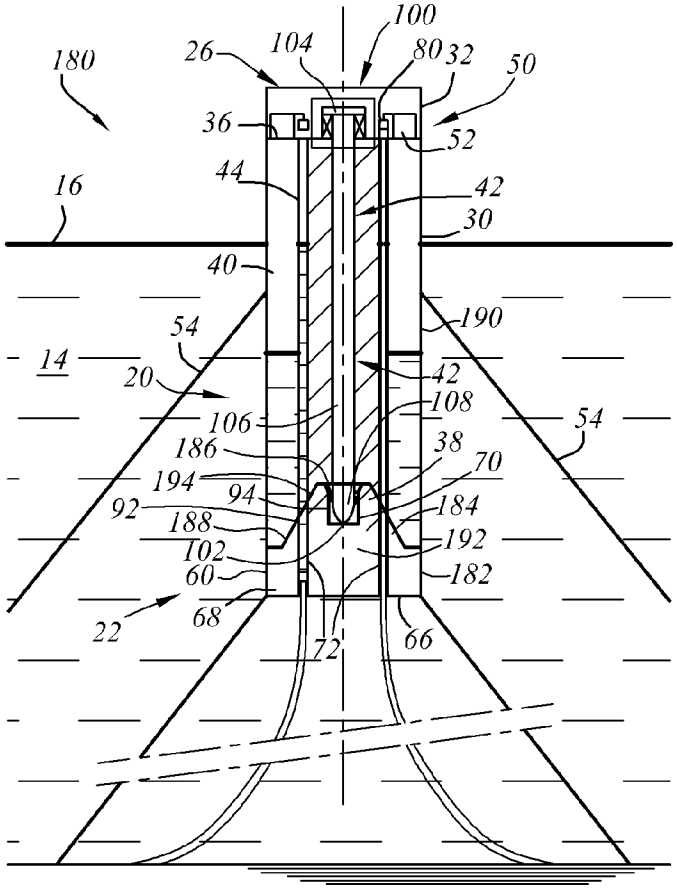
FIG. 8 is a similar view to FIG. 1 of a second fluid production installation according to the invention.
Figure 9:
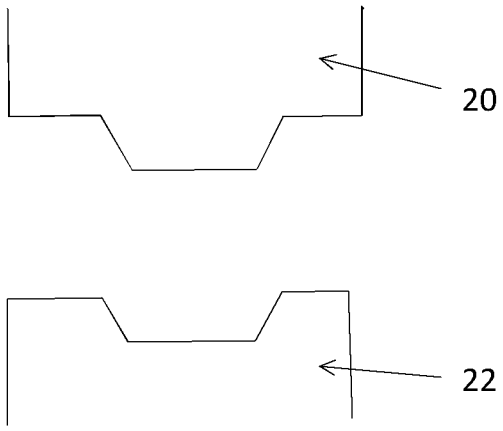
FIG. 9 is a similar view to FIG. 7 of the second fluid production installation according to the invention.

A second fluid production installation according to the invention is illustrated FIGS. 8 and 9. Unlike the first installation 10, the base 60 of the bottom structure 22 comprises a base part 182 of substantially cylindrical shape and an upper part 184 which projects from the base part towards the top structure 20. The upper projecting part 184 is in the shape of a truncated cone. Its upper surface 64 therefore has a substantially horizontal upper region 186 of vertical axis A-A' and a lateral region 188 of truncated cone shape.

The passages 72 extend through the base part 182 and the projecting part 184. They open into the lateral region 188. The lower insertion passage 70 opens into the upper region 186. The passage 70 is a blind passage.

The maximum width of the projecting upper part 184 is greater than at least 0.5 times the width of the base 60.

The top structure 20 also comprises an upper part 190 and a hollow lower part 192. The lower part 192 delimits a lower receiver housing 194 whose shape mates with the projecting part 184. The housing 194 opens downwardly. It is delimited by a lower surface 38 also of truncated cone shape.

The central passage 42 opens into the housing 194 so that the rigid rod 90 of the retaining means partly projects into this housing 194, without extending outside the housing 194.

The axial passages 44 also open into the housing 194.

In the production position illustrated FIG. 8, the projecting part 184 is inserted so that it mates with the housing 194. Therefore the upper surface 64 of the bottom structure 22 cooperates radially around axis A-A' with the lower surface 38 for transmission of any radial stresses which may be applied to the top structure 20 or to the bottom structure 22.

Therefore, the rod 90 does not undergo any radial stress which means that the risk of shearing of this rod 90 is substantially zero.

When the top structure 20 must be disconnected, the upper projecting part 184 moves out of the housing 194 as illustrated in FIG. 9, following upward displacement of the top structure 20 by increasing the buoyancy thereof. The top structure 20 can then be evacuated as described previously.

What is claimed is:

1. An installation for fluid production in a stretch of water, the installation comprising:

a floating top structure extending partly above a surface of the stretch of water;

a bottom structure fully submerged under the surface of the stretch of water, the bottom structure comprising:

a base placed distant from the bed of the stretch of water, and an anchoring structure configured to anchor the base onto the bed of the stretch of water;

at least one fluid conveying riser intended to connect a bed assembly located on the bed of the stretch of water to a surface assembly located on the top structure;

the top structure being mobile between a production position mounted on the bottom structure, and a evacuation position away from the bottom structure, the installation comprising for a retainer configured to retain the top structure in its production position, wherein the retaining means comprise:

at least one rigid rod carried by the top structure, the rigid rod extending between an upper end located above the surface of the stretch of water and a lower end, the rigid rod being mounted mobile in translation relative to the top structure between a bottom position in which the lower end projects towards the base and a top position retracted towards the top structure;

at least one rod abutment carried by the rigid rod in the vicinity of the lower end;

at least one complementary abutment secured to the base, the at least one rod abutment and the complementary abutment being mobile in rotation relative to one another between an engaged configuration in which urging of the rigid rod towards its top position retains the top structure in its production position on the bottom structure, and a disengaged configuration releasing the top structure from the bottom structure; and a mechanical locking assembly for locking the rigid rod, the locking assembly being carried by the top structure above the surface of the stretch of water.

2. The installation according to claim 1, wherein the at least one rod abutment projects radially relative to a peripheral surface of the at least rigid rod delimiting at least one axial passage, the at least one axial passage positioned and configured to receive the at least one complementary abutment, the at least one complementary abutment delimiting at least one complementary axial passage, the at least one complementary axial passage positioned and configured to receive the at least one rod abutment when the at least one rigid rod is moved axially between the top position and the bottom position.

3. The installation according to claim 1, wherein the at least one rod abutment is located on an outer peripheral surface of the at least one rigid rod and projects radially away from a rod axis;

the base delimiting an insertion passage configured to receive a lower end of the at least one rigid rod;

the at least one complementary abutment projecting radially into the insertion passage towards the rod axis when the rigid rod is inserted in the insertion passage.

4. The installation according to claim 1, wherein the retainer comprises a translational driving mechanism configured and positioned to drive the rigid rod in translation between the top position and the bottom position, the translational driving mechanism being carried by the top structure above the surface of the stretch of water.

5. The installation according to claim 1, wherein the at least one complementary abutment is mounted fixed in rotation around a rod axis relative to the base, the at least one rigid rod being mounted mobile in rotation around the rod axis to cause the at least one rod abutment to change from the engaged configuration to the disengaged configuration when the at least one rigid rod takes up the bottom position;

the retainer comprising a rotational driving mechanism configured to drive the rigid rod in rotation around the rod axis, the rotational driving mechanism being carried by the top structure and being arranged above the surface of the stretch of water.

6. The installation according to claim 4, wherein the translation driving mechanism is carried by the rotational driving mechanism, and is movable in rotation around the rod axis jointly with the at least one rigid rod when the at least one rod abutment moves between the engaged configuration and the disengaged configuration.

7. The installation according to claim 1, wherein the base is held away from the bed of the stretch of water by its own buoyancy, the anchoring structure comprising at least one flexible line connecting the base to the bed of the stretch of water.

8. The installation according to claim 1, wherein the top structure has a height, taken along a rod axis, greater than at least twice the maximum transverse dimension of the top structure, taken perpendicular to the rod axis.

9. The installation according to claim 1, wherein the top structure delimits an upper insertion passage positioned and configured to receive the at least one retaining rod, the upper insertion passage having at least one part with an inner cross section that is conjugate with an outer cross section of the at least one rigid rod, located under the surface of the stretch of water.

10. The installation according to claim 1, wherein the conveying riser comprises:

at least one upper part flexible over its entire length and mobile between a lower disengaged configuration of the top structure and retained by the bottom structure; and an upper connected configuration on the top structure in which its upper end is connected to the top structure.

11. The installation according to claim 1, wherein a first structure from among the floating top structure and the bottom structure comprises a projecting part of truncated cone shape, extending around the rod opposite the second structure from among the floating top structure and the bottom structure; and the second structure from among the floating top structure and bottom structure defines a housing positioned and configured to receive the projecting part, the housing having a shape configured to mate with the projecting part to receive the projecting part in the production position.

12. A method for producing a fluid in a stretch of water by an installation according to claim 1, wherein the method comprises the following steps:

placing the top structure of the installation facing the bottom structure;

moving the retaining rod from its top position to its bottom position so that it engages in the bottom structure;

rotating the at least one rod abutment relative to the at least one complementary abutment to move the at least one rod abutment to its engaged configuration with a complementary abutment part;

applying an urging force on the retaining rod towards its top position, to apply the top structure against the bottom structure;

engaging the fluid conveying riser through the top structure, and connecting the upper end of the fluid conveying riser onto the top structure.

13. The method according to claim 12, wherein the method further comprises an emergency disconnection step comprising:

disconnecting the fluid conveying riser, and moving the fluid conveying riser away from the top structure, rotating the at least one rod abutment relative to the at least one complementary abutment part between the engaged configuration and the disengaged configuration;

moving the retaining rod from the bottom position to the top position, moving the top structure away from the bottom structure towards the evacuation position.

14. The installation according to claim 5, wherein the translational driving mechanism is carried by the rotational driving mechanism and is moveable in rotation around the rod axis jointly with the at least one rigid rod when at least one rod abutment moves between the engaged configuration and the disengaged configuration.

15. The installation according to claim 1, wherein the mechanical locking assembly comprise at least one screw-and-nut assembly comprising a fixed screw and a hydraulic nut, the at least one screw-and-nut assembly configured to move mechanically the rigid rod in translation along the vertical rod axis and in rotation around the vertical axis, and configured to lock the rigid rod, the at least one screw-and-nut assembly being carried by the top structure above the surface of the stretch of water.

16. An installation for fluid production in a stretch of water, the installation comprising:

a floating top structure extending partly above a surface of the stretch of water;

a bottom structure fully submerged under the surface of the stretch of water, the bottom structure comprising:

a base placed distant from a bed of the stretch of water, and an anchoring structure configured to anchor the base onto the bed of the stretch of water;

at least one fluid conveying riser configured to connect a bed assembly located on the bed of the stretch of water to a surface assembly located on the top structure;

the top structure being mobile between a production position mounted on the bottom structure, and an evacuation position away from the bottom structure, the installation comprising a retainer configured to retain the top structure in the production position, wherein the retainer comprises:

at least one rigid rod carried by the top structure, the rigid rod extending between an upper end located above the surface of the stretch of water and a lower end, the rigid rod being mounted mobile in translation relative to the top structure between a bottom position in which the lower end projects towards the base and a top position retracted towards the top structure;

at least one rod abutment carried by the rigid rod in a vicinity of the lower end; and at least one complementary abutment secured to the base, the at least one rod abutment and the complementary abutment being mobile in rotation relative to one another between an engaged configuration in which urging of the rigid rod towards its top position retains the top structure in the production position on the bottom structure, and a disengaged configuration releasing the top structure from the bottom structure, wherein the rigid rod is mobile in translation along its longitudinal axis, the retainer comprising a longitudinal blocking assembly for blocking the rod along the longitudinal axis, the blocking assembly being carried by the top structure above the surface of the stretch of water.

* * * * *